United States Patent [19]

Reyenga et al.

[11] 4,228,117

[45] Oct. 14, 1980

[54] MELT SPINNING PROCESS FOR PRODUCING NYLON 66 YARNS

[75] Inventors: Gerald J. Reyenga; Arnold E. Wilkie, both of Pensacola Beach, Fla.

[73] Assignee: Monsanto Company, St. Louis, Mo.

[21] Appl. No.: 11,980

[22] Filed: Feb. 14, 1979

Related U.S. Application Data

[63] Continuation of Ser. No. 864,990, Dec. 27, 1977, abandoned.

[51] Int. Cl.[3] ..... B28B 3/20

[52] U.S. Cl. ..... 264/176 F; 264/234

[58] Field of Search ..... 264/176 F, 210 F, 234

[56] References Cited

U.S. PATENT DOCUMENTS

| | | | |
|---|---|---|---|
| 3,987,136 | 10/1976 | Schippers | 264/103 |
| 4,093,147 | 6/1978 | Bromley et al. | 264/210 F |

FOREIGN PATENT DOCUMENTS

| | | | |
|---|---|---|---|
| 45-24685 | 8/1970 | Japan | 264/210 F |
| 46-13933 | 4/1971 | Japan | 264/210 F |
| 48-28012 | 8/1973 | Japan | 264/210 F |
| 1174867 | 12/1969 | United Kingdom | 264/210 F |

*Primary Examiner*—Jay H. Woo

*Attorney, Agent, or Firm*—John W. Whisler

[57] ABSTRACT

The productivity of the conventional melt spinning process for producing undrawn polyhexamethylene adipamide carpet and tire yarns is increased by utilizing a heat feed roll (e.g. 80° C.) rather than an unheated feed roll and by eliminating the conventional steam conditioning of the yarn and the convergence guide(s) associated therewith.

2 Claims, No Drawings

MELT SPINNING PROCESS FOR PRODUCING NYLON 66 YARNS

This is a continuation of application Ser. No. 864,990 filed Dec. 27, 1977 and now abandoned.

BACKGROUND OF THE INVENTION

A. Field of the Invention

This invention relates to an improvement in the melt spinning process for producing undrawn polyhexamethylene adipamide (nylon 66) carpet and tire yarns whereby the spinning productivity in terms of pounds of yarn per unit time is significantly increased.

B. Description of the Prior Art

In the conventional production of melt spun nylon 66 carpet and tire yarns the melt spinning process and drawing process may be carried out in a single operation (i.e. coupled mode) or the processes may be carried out separately (i.e. discontinuous mode). The present invention relates to an improvement in the melt spinning process of the discontinuous mode. In the conventional melt spinning process of the discontinuous mode normally composed of an undrawn yarn from 60 to 420 filaments and having a denier per filament (dpf) between about 30 and about 60 is produced. From the standpoint of economical considerations it is desirable to operate the melt spinning process under conditions which maximize productivity without sacrificing important yarn properties or causing processing difficulties. Conventionally, the yarn is conditioned with steam prior to being wound onto bobbin(s) (i.e. packaged) so as to facilitate packaging. If the yarn is not steam conditioned, the yarn grows (elongates) on and sluffs off the bobbin(s). This is especially a problem in tandem windup process where the filaments (after being quenched) are separated into two bundles or yarns each of which is wound onto its own bobbin. Normally, both yarns have the same number of filaments. In carrying out the process molten nylon 66 is extruded at a given rate through orifices of a spinneret to form a plurality of molten streams. The molten streams cool and elongate as they move away from the spinneret. The cooling is assisted by a stream of flowing air in a quenching chamber, commonly referred to as a chimney. Typically, one side of the filaments is exposed to a stream of transverse air in the chimney. The solidified streams (i.e. filaments) pass over a convergence guide or pair of convergence guides (in the case of the tandem windup process) positioned near the lower end of the chimney. From the chimney the converged filaments, i.e. yarn(s) pass through a conditioning tube into which steam is introduced at a given rate. The convergence guide(s) in the chimney prevent nonuniformity in denier among the filaments which would otherwise result if the filaments were permitted to be whipped about by the steam. Also, in the tandem windup process the convergence guides separate the filaments into two yarns. The yarn(s) are withdrawn from the conditioning tube and forwarded by means of a rotating roll (feed roll) and, optionally, its associated separator roll to a take-up bobbin(s) onto which the yarn is wound to form package(s). The yarn(s) make a sufficient number of wraps (at least a partial wrap) around the feed roll (and separator roll) to prevent the yarn(s) from slipping on the roll. Neither the feed roll nor the separator roll are heated. The feed roll is driven at substantially the same peripheral speed as the take-up bobbin(s) and is correlated with the extrusion rate to provide yarn(s) of a desired dpf. Normally, a spin finish is applied to the yarn(s) between the steam conditioning tube and the feed roll. Normally, the process occupies two floors, one directly over the other. The spinning is carried out on the upper floor and the yarn(s) are packaged on the lower floor. The conditioning tube, sometimes referred to as the "interfloor tube", provides a passage for the yarn(s) between floors. Uncontrolled variations in interfloor pressure and steam conditioning pressure must be avoided in order to obtain a yarn of uniform denier and properties. Proper control of these pressures is troublesome.

The resulting undrawn yarn(s) are then used as feed yarn(s) in a drawing process in which the yarn(s) are drawn to a desired denier. The drawing process may be accomplished in a conventional manner using conventional equipment designed for this purpose and, in the case of carpet yarn, may be coupled with a texturing process. Normally, carpet yarn is drawn at a draw ratio between 2 and 4 and tire yarn is drawn at a draw ratio between 4 and 6.

The productivity of the foregoing melt spinning process is limited in one or more ways. In the case of carpet yarn the process is so-called "quench limited" in that there is a maximum extrusion rate at a constant dpf beyond which the filaments tend to stick to one another at their point of convergence in the chimney. On the other hand, in the case of tire yarn the process is also "property limited" in that there is also a maximum extrusion rate at constant dpf beyond which the elongation of the yarn after being drawn is too low, that is, is unacceptable for tire yarn uses. The extrusion rate at which the process becomes property limited is lower than that at which it becomes quench limited.

Accordingly, it is the main object of the present invention to provide an improvement in the melt spinning process for producing undrawn nylon 66 carpet and tire yarns whereby the productivity of the process in terms of pounds of yarn per unit time is significantly increased.

Other objects and advantages of the invention will become apparent from the detailed description thereof hereinafter.

SUMMARY OF THE INVENTION

In general, the present invention provides an improvement in the conventional melt spinning process for producing undrawn nylon 66 carpet and tire yarns whereby higher extrusion rates may be successfully employed thereby increasing the productivity of the process. The improvement comprises heating the feed-roll, eliminating the conventional steam conditioning treatment of the yarn and the convergence guide(s) in the chimney associated therewith. The feed roll is sufficiently heated so as to maintain it at a temperature ranging from about 40° C. to about 150° C. with a temperature ranging from about 60° C. to about 120° C. being particularly preferred.

It has been found that when a heated feed roll is used in the process, acceptable package(s) of undrawn yarn(s) can be obtained without the use of either steam or the associated convergence guide(s) in the chimney. When the convergence guide(s) are removed, higher extrusion rates can be utilized without the filaments sticking to one another. The reason for this is that the filaments now converge at a point further downstream in the process (e.g., on the feed roll or on the finish roll rather than on the convergence guide in the chimney)

and, consequently, are cooler when converged. When steam is eliminated, the troublesome problems involved in controlling ambient air pressure between the spinning and wind-up floors and steam conditioning pressure are also eliminated.

In the case of tire yarn the heated feed roll permits the use of higher extrusion rates without causing unacceptable losses in the elongation-at-break of the drawn yarn which otherwise result when higher extrusion rates are used in combination with steam conditioning. Steam conditioning and the use of associated guides tend to increase the spun orientation of the yarn. Also, the spun orientation increases with increasing extrusion rates. It is generally well-recognized that as the spun orientation (as measured by spun birefringence) increases, the elongation-at-break of the drawn yarn decreases. Thus, by eliminating steam and the associated convergence guide(s), higher extrusion rates can be utilized without adversely affecting the elongation-to-break of the drawn yarn.

Accordingly, the improvement of the present invention increases the productivity in terms of pounds of yarn per unit time of the conventional melt spinning process for producing undrawn nylon 66 carpet and tire yarns without causing processing difficulties, such as packaging difficulties, and without sacrificing losses in important yarn properties, such as elongation of the ultimate drawn yarn.

The improvement of this invention is of particular value in use with melt spinning processes which are carried out on existing equipment where polymer capacity is available but the processes are quench or property limited in the manner hereinabove described.

DETAILED DESCRIPTION OF THE PREFERRED EMBODIMENTS OF THE INVENTION

In carrying out the improvement of this invention the above-described conventional process is modified by using a heated rather than unheated feed roll, eliminating steam and by removing the convergence guide(s) in the chimney. Preferably, the feed roll is electrically heated, thereby providing means for easily controlling the temperature of the feed roll. The yarn(s) makes a sufficient number of wraps, at least a partial wrap and usually one or more wraps, around the heated feed roll or the heated feed roll and its associated separator roll so as to assure that the yarn(s) do not slip on the roll. If desired, instead of a separator roll, a second heated roll may be employed or alternatively, other roll arrangements may be employed in which one or more of the rolls are heated. The temperature of the heated roll or rolls may range from about 40° C. to about 150° C. with a temperature ranging from about 60° C. to about 80° C. being preferred in the case of tire yarn and from about 60° C. to about 120° C. being preferred in the case of carpet yarn. The temperature at which the heated roll is maintained is, of course, influenced by the residence time or contact time of the yarn(s) on the heated roll and is correlated with the number of wraps taken by the yarn(s) around the roll and the peripheral speed of the roll to provide yarn(s) of optimum or desired properties.

While the use of a conditioning tube is not required in carrying out the process of the invention, such a tube may be used without the use of steam, if desired.

In practice, a finish is normally applied to undrawn yarn(s) just upstream from the feed roll to facilitate subsequent processing of the yarn(s). When a finish roll is used with the process of the invention, the filaments converge thereon to form a yarn(s). In the absence of such a roll or other surface, the filaments converge on the heated feed roll.

The following examples are given for purposes of further illustrating the invention and are not in any way intended to limit the invention thereto.

EXAMPLE 1

In this example 30 denier per filament undrawn tire yarns, each composed of 140 filaments of round cross-section, were prepared from nylon 66 according to the process of the invention and, for purposes of comparison, according to the hereinabove-described conventional process.

First, two control yarns (C-439 and C-488) were prepared using the conventional process. In each instance, molten nylon 66 of commercial fiber-forming grade was extruded through a spinneret having 280 circular holes (two sets of 140 holes) into a conventional melt spinning chimney having a cross-flow of cooling air at about 18°-20° C. The chimney was positioned immediately below the spinneret and measured about 6 feet (1.8 meters) in length. The filaments solidified in the chimney and were converged to form two yarns by means of a pair of convergence positioned near the outlet end (bottom) of the chimney at a distance of about 6 feet (1.8 meters) from the lower face of the spinneret. The yarns passed from the chimney directly into a conventional steam conditioning tube measuring about 4 feet (1.2 meters) in length through which saturated steam was passed. The yarns were withdrawn from the conditioning tube and forwarded to tandem take-up bobbins (where the yarns were wound into packages) by means of an unheated feed roll (i.e. feed wheel) around which the yarns made one complete wrap. Between the conditioning tube and the feed roll the yarns passed into contact with a finish roll which wetted the yarns with a spin finish. The finish roll was located about 12 feet (3.7 meters) from the lower face of the spinneret. The peripheral speed of the feed roll and the extrusion rate was correlated to provide a nominal 30 denier per filament (dpf) yarns. The yarns were taken up under a slight tension to facilitate packaging thereof. One of the control yarns (C-439) was produced employing a take-up speed of 480 yards (439 meters) per minute while the other control yarn (C-488) was produced employing a take-up speed of 534 yards (488 meters) per minute.

A yarn (A-503) was then prepared in accordance with the process of the present invention using the foregoing procedure except that in this instance a heated feed roll was used instead of an unheated roll, the convergence guides in the chimney and the steam were omitted and a take-up speed of 503 meters per minute was employed. The processing conditions utilized in preparing the yarns are summarized in the following table:

TABLE I

| | C-439 | C-488 | A-503 |
|---|---|---|---|
| Wind-up Speeds (meters per minute) | 439 | 488 | 503 |
| Feed Roll Temperature (°C.) | unheated | unheated | 80 |
| Air Flow (liters per minute) | 9346 | 9912 | 9912 |
| Extrusion Rate (kilograms per hour) | 22.9 | 25.5 | 27.6 |
| Convergence Guide in Chimney | yes | yes | no |

TABLE I-continued

| | C-439 | C-488 | A-503 |
|---|---|---|---|
| Steam In Conditioning Tube | yes | yes | no |
| Acceptable Packages | yes | yes | yes |

Each of the above yarns were drawn under the same conditions in a separate operation using conventional drawing equipment. Physical properties of the resulting yarns were determined and are given in the following table along with the draw ratio employed and the denier of the drawn yarn. In the table T represents tenacity expressed in grams per denier (gpd) and E represents elongation-to-break expressed as a percentage of the initial drawn length of the yarn.

TABLE II

| | C-439 | C-488 | A-503 |
|---|---|---|---|
| Spun Birefringence | 0.0072 | 0.0078 | 0.0068 |
| Draw Ratio | 5.0056 | 4.9605 | 5.1569 |
| Yarn Denier | 835 | 863 | 859 |
| T (gpd) | 9.25 | 8.86 | 9.13 |
| E (%) | 13.1 | 12.8 | 14.3 |

For tire yarn application, the drawn yarn must have an elongation of not less than 13%. The data in the above tables show that in the conventional melt spinning process, when the extrusion rate is increased so as to provide a wind-up speed greater than about 440 meters per minute the resulting yarn when drawn has unacceptable elongation. In contrast, the data show that the process of this invention can be operated at higher extrusion rates and wind-up speeds in excess of 503 meters per minute while still providing yarn which when drawn has acceptable elongation and tenacity. In fact, it will be observed that the properties of yarn A-503 are superior to those of either of the control yarns and yet is produced at a significantly higher extrusion rate and wind-up speed.

EXAMPLE 2

In this example 60 denier per filament undrawn carpet yarns each composed of 68 filaments of triskelion cross-section was employed.

In one run yarn was prepared in the conventional manner using an unheated feed roll, steam in the conditioning tube and a convergence guide in the chimney. In this instance the maximum extrusion rate that could be utilized without causing sticking of the filaments at the convergence guide was 71 lbs. (32.2 kilograms) per hour. A second yarn was then prepared in accordance with the improvement of the present invention. This run was carried out identically to the above run except that in this run the steam was omitted from the conditioning tube, the convergence guide in the chimney was removed, and the feed roll was maintained at a temperature of 80° C. In this instance, the extrusion rate was 97 lbs. (44 kilograms) per hour. This represented an increase in productivity of 11.8 kilograms per hour or over 36%.

We claim:

1. A melt spinning process for producing a package of undrawn polyhexamethylene adipamide yarn composed of 140 filaments each having a nominal denier of 30 without conditioning the yarn with steam prior to forming said package, comprising:

(a) extruding molten fiber-forming polyhexamethylene adipamide at a given rate through a spinneret having at least one set of 140 circular holes to form molten streams, (b) cooling said molten streams in a quenching chamber to provide filaments, (c) withdrawing said filaments from said quenching chamber, (d) passing said filaments with at least a partial wrap around a roll maintained at a temperature ranging from 40° C. to about 150° C. and driven at a given peripheral speed, (e) forwarding said filament from said roll to a take-up bobbin onto which the filaments are wound to form said package wherein the extrusion rate and said peripheral speed are correlated to provide a yarn having a nominal denier per filament of 30 and an elongation-to-break of not less than 13.0% when the yarn is drawn to a nominal denier per filament of 6.

2. The process of claim 1 wherein the feed roll is maintained at a temperature between about 60° C. and about 120° C.

* * * * *